US012258819B1

(12) United States Patent
Halterman et al.

(10) Patent No.: US 12,258,819 B1
(45) Date of Patent: Mar. 25, 2025

(54) AUTOMATED CHANGING OF DRILL BITS VIA MAST ANGLE

(71) Applicant: Caterpillar Global Mining Equipment LLC, Denison, TX (US)

(72) Inventors: John Francis Halterman, Sherman, TX (US); Yagneshwar Natarajan, Chennai (IN)

(73) Assignee: Caterpillar Global Mining Equipment LLC, Denison, TX (US)

( * ) Notice: Subject to any disclaimer, the term of this patent is extended or adjusted under 35 U.S.C. 154(b) by 0 days.

(21) Appl. No.: 18/637,193

(22) Filed: Apr. 16, 2024

(51) Int. Cl.
*E21B 19/18* (2006.01)
*E21B 19/20* (2006.01)

(52) U.S. Cl.
CPC ..... *E21B 19/18* (2013.01); *E21B 19/20* (2013.01)

(58) Field of Classification Search
CPC ..... E21B 19/146; E21B 19/14; E21B 19/18
See application file for complete search history.

(56) References Cited

U.S. PATENT DOCUMENTS 8,342,236 B2 1/2013 Bienfang et al.
9,523,269 B2 * 12/2016 Hoult ..... E21B 44/00
11,142,970 B2 10/2021 Gaska et al.
11,466,522 B2 * 10/2022 Fosler ..... E21B 19/20
2016/0084061 A1 * 3/2016 McHugh ..... E21B 44/02 700/275
2017/0101860 A1 * 4/2017 Nieminen ..... E21B 7/025
2021/0198960 A1 * 7/2021 Branson ..... E21B 10/00
2023/0323743 A1 10/2023 Little et al.
2024/0328264 A1 * 10/2024 Frade ..... E21B 17/042

FOREIGN PATENT DOCUMENTS

AU 2007314668 B2 2/2013
WO 2023019331 A1 2/2023

* cited by examiner

*Primary Examiner* — Kipp C Wallace

(57) ABSTRACT

During drilling operations by a drilling rig, drill bits may need to be changed, which can lead to inefficiency. Thus, a process is disclosed for automatically changing drill bits. The process utilizes the existing ability of the drill to tilt. In particular, a magazine may be provided that comprise a plurality of drill-bit pockets arranged in at least one column. Each of the drill-bit pockets within one column holds a drill bit at a different angle within the range of angles at which the drill is able to tilt. The process may control the angle of the drill to align with the angle of any one of the drill-bit pockets, and operate a drill string to release a drill bit into, or engage a drill bit within, that drill-bit pocket. Also, the magazine may comprise two or more columns, in which case, the magazine may be configured to slide laterally.

20 Claims, 9 Drawing Sheets

AUTOMATED CHANGING OF DRILL BITS VIA MAST ANGLE

TECHNICAL FIELD

The embodiments described herein are generally directed to drilling, and, more particularly, to the automated changing of drill bits via mast angle.

BACKGROUND

During a drilling operation (e.g., drilling surface rock) by a drilling rig, the drill bit needs to be changed from time to time. To change the drill bit, the used drill bit must be removed from the drill string, the used drill bit must be stored, and a new drill bit must be installed on the drill string. Ideally, for the sake of efficiency and safety, this process would be done without direct human intervention.

A number of solutions exist for automated changing of drill bits. For example, Australian Application No. AU 2007314668 B2, published on Feb. 28, 2013, International Patent Publication No. WO 2023/019331 A1, published on Feb. 23, 2023, U.S. Patent Publication No. 2023/0323743 A1, published on Oct. 12, 2023, and U.S. Pat. No. 11,142,970 B2, issued on Oct. 12, 2021, describe various mechanisms for automatically changing drill bits.

The present disclosure is directed toward overcoming one or more of the problems discovered by the inventors.

SUMMARY

In an embodiment, a magazine to hold drill bits for a drilling rig is disclosed, the magazine comprising: a housing that includes a plurality of drill-bit pockets, wherein each of the plurality of drill-bit pockets is configured to receive at least a portion of a drilling end of a drill bit, such that an engagement end of the drill bit is accessible at an open end of that drill-bit pocket, wherein at least a first one of the plurality of drill-bit pockets is positioned vertically below a second one of the plurality of drill-bit pockets, wherein the first drill-bit pocket holds a first drill bit at a first angle with respect to a reference axis, and wherein the second drill-bit pocket holds a second drill bit at a second angle with respect to the reference axis, wherein the second angle is smaller than the first angle.

In an embodiment, a drilling rig comprises: a machine body comprising a platform that defines a reference axis; a magazine attached to the platform, wherein the magazine comprises a housing that includes a plurality of drill-bit pockets, wherein each of the plurality of drill-bit pockets is configured to receive at least a portion of a drilling end of a drill bit, such that an engagement end of the drill bit is accessible at an open end of that drill-bit pocket, wherein the plurality of drill-bit pockets comprises one or more columns of two or more vertically arranged drill-bit pockets, and wherein each of the two or more vertically arranged drill-bit pockets in each of the one or more columns is angled at an angle that is different with respect to the reference axis than the angle of any others of the two or more vertically arranged drill-bit pockets in that column; a mast attached to the machine body and configured to tilt a drill between a range of angles with respect to the reference axis, wherein the range of angles includes the angle of each of the two or more vertically arranged drill-bit pockets in each of the one or more columns; one or more ground-engaging members configured to move the machine body with respect to a ground; and a controller configured to change a used drill bit of the drill by controlling the mast to tilt the drill to the angle of any selected one of the plurality of drill-bit pockets, so as to align a drill axis of the drill with an engagement axis of the selected drill-bit pocket.

In an embodiment, a controller of a drilling rig is disclosed, the drilling rig comprising a machine body comprising a platform that defines a reference axis, a magazine, wherein the magazine comprises a housing that includes a plurality of drill-bit pockets, wherein each of the plurality of drill-bit pockets is configured to receive at least a portion of a drilling end of a drill bit, such that an engagement end of the drill bit is accessible at an open end of that drill-bit pocket, wherein the plurality of drill-bit pockets comprises one or more columns of two or more vertically arranged drill-bit pockets, and wherein each of the two or more vertically arranged drill-bit pockets in each of the one or more columns is angled at an angle that is different with respect to the reference axis than the angle of any others of the two or more vertically arranged drill-bit pockets in that column, and a mast attached to the machine body and configured to tilt a drill between a range of angles with respect to the reference axis, wherein the range of angles includes the angle of each of the two or more vertically arranged drill-bit pockets in each of the one or more columns, wherein the controller is configured to: determine to change a used drill bit; and in response to determining to change the used drill bit, select an empty one of the plurality of drill-bit pockets in the magazine, control the mast to tilt the drill to an angle, with respect to the reference axis, that matches an angle of the selected empty drill-bit pocket, operate a drill string of the drill to release the used drill bit into the selected empty drill-bit pocket, select an occupied one of the plurality of drill-bit pockets in the magazine, control the mast to tilt the drill to an angle, with respect to the reference axis, that matches an angle of the selected occupied drill-bit pocket, and operate the drill string of the drill to engage a new drill bit held by the selected occupied drill-bit pocket.

BRIEF DESCRIPTION OF THE DRAWINGS

The details of embodiments of the present disclosure, both as to their structure and operation, may be gleaned in part by study of the accompanying drawings, in which like reference numerals refer to like parts, and in which.

DETAILED DESCRIPTION

Figure 1:
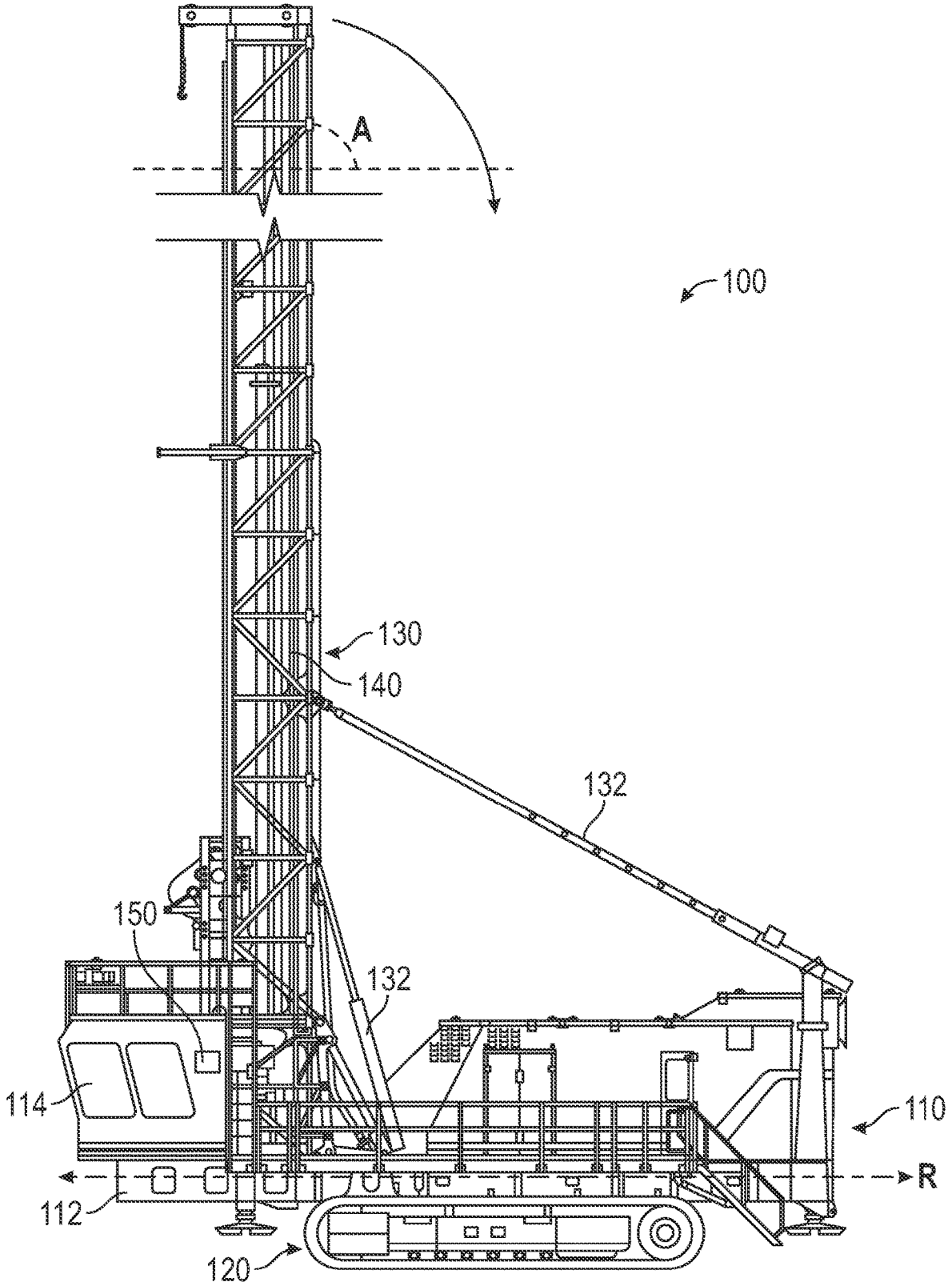
FIG. 1 illustrates a side view of a drilling rig, according to an embodiment.

The detailed description set forth below, in connection with the accompanying drawings, is intended as a description of various embodiments, and is not intended to represent the only embodiments in which the disclosure may be practiced. The detailed description includes specific details for the purpose of providing a thorough understanding of the embodiments. However, it will be apparent to those skilled in the art that embodiments of the invention can be practiced without these specific details.

In some instances, well-known structures and components are shown in simplified form for brevity of description. For clarity and ease of explanation, some surfaces and details may be omitted in the present description and figures. It should also be understood that the various components illustrated herein are not necessarily drawn to scale. In other words, the features disclosed in various embodiments may be implemented using different relative dimensions within and between components than those illustrated in the drawings.

The terms "side," "top," "bottom," "front," "rear," "above," "below," and the like are used for convenience of understanding, to convey the relative positions of various components with respect to each other, and do not imply any specific orientation of those components in absolute terms (e.g., with respect to the external environment or the ground). In addition, the terms "respective" and "respectively" signify an association between members of a group of first components and members of a group of second components. For example, the phrase "each component A connected to a respective component B" would signify A1 connected to B1, A2 connected to B2, . . . and AN connected to BN. Furthermore, a reference numeral with an appended letter will be used herein to refer to a specific component, whereas the same reference numeral without any appended letter will be used to refer collectively to a plurality of the component or to refer to a generic or arbitrary instance of the component. Similarly, a reference letter with an appended number will be used herein to refer to a specific parameter, whereas the same reference letter without any appended number will be used to refer collectively to a plurality of the parameter or to refer to a generic or arbitrary instance of the parameter.

FIG. 1 illustrates a side view of a drilling rig 100, according to an embodiment. Drilling rig 100 comprises a machine body 110, which includes a platform 112 that is supported off the ground by one or more ground-engaging members 120. Platform 112, which may also be referred to as a "drill deck," defines a reference axis R. Examples of drilling rig 100 include any of the rotary drills (e.g., models numbers MD6200, MD6240, MD6250, MD6290, MD6310, MD6380, MD6420C, MD6540, MD6540C, MD6640, etc.) manufactured by Caterpillar Inc. of Irving, Texas or other manufacturers. However, it should be understood that disclosed embodiments may be applied to any drilling rig with a drill capable of being rotated through a plurality of angles.

Platform 112 may support a cabin 114, a mast 130, an internal combustion engine or electric motor (not shown), and other various components of machine body 110. Cabin 114 may be configured to accommodate a local human operator and may comprise one or more machine controls, by which the local human operator may control one or more subsystems of drilling rig 100. In an alternative embodiment, such as in the case of an autonomous or remotely controlled drilling rig 100, cabin 114 may be omitted.

Ground-engaging member(s) 120, which may be driven by an internal combustion engine or electric motor in machine body 110, are configured to move machine body 110 with respect to the ground. Ground-engaging member(s) 120 are illustrated as a pair of tracks on either side of machine body 110. However, in an alternative embodiment, ground-engaging members 120 may comprise a plurality of (e.g., four or more) wheels or the like.

Mast 130 supports a drill 140. Drill 140 may comprise components that are configured to move, relative to mast 130, so as to extend towards and into the ground below machine body 110. For example, drill 140 may comprise a drill string (not shown) with a drill bit attached to a drilling end. The drill string may extend outwards from a cylinder to drill into the ground using the drill bit.

Mast 130 is attached to machine body 110 and configured to rotate or tilt drill 140 between a range of angles with respect to reference axis R. In an embodiment, the orientation of drill 140 is fixed relative to mast 130, and mast 130 is itself configured to rotate or tilt between the range of angles with respect to reference axis R, to thereby tilt drill 140 via the fixation between mast 130 and drill 140. For example, mast 130 may be configured to tilt backwards (e.g., towards the rear of machine body 110) via one or more hydraulic supports 132. In particular, hydraulic supports 132 may be configured to retract (e.g., by reducing hydraulic pressure within the respective hydraulic cylinder) to tilt mast 130 down, and extend (e.g., by increasing hydraulic pressure within the respective hydraulic cylinder) to tilt mast 130 up. In an alternative embodiment, other means may be used to tilt mast 130 through the range of angles.

In the illustrated example, the angle A of mast 130, relative to reference axis R, is 90-degrees, which may be an upper limit of the range of angles of mast 130. Mast 130 may be configured to tilt down to a 0-degree angle, such that mast 130 is lying horizontally on platform 110. In this case, the range of angles is from 0-degrees to 90-degrees. Mast 130 may be fixable at each of a plurality of angles within the range of angles (e.g., via a locking mechanism), to thereby fix both mast 130 and drill 140 at that angle. Once fixed at a particular angle with respect to reference axis R, drill 140 may be operated to drill into the ground at that angle.

Drilling rig 100 may comprise a controller 150 that is configured to perform one or more of the processes described herein, including automatically changing drill bits. While controller 150 is illustrated in a particular location on machine body 110, it should be understood that controller 150 may positioned in any alternative location on drilling rig 100, as may be dictated by one or more design factors. In addition, while controller 150 is illustrated as a single unit, controller 150 may, in practice, comprise a plurality of separate, but communicatively coupled, control units, distributed at various positions throughout drilling rig 100.

Controller 150 may be an electronic control unit (ECU) that controls one or more subsystems of drilling rig 100 (e.g., the engine or motor driving ground-engaging members 120, hydraulic supports 132 of mast 130, the drill string of drill 140, etc.). Control may be provided by a local human operator (e.g., via machine control(s) in cabin 114), a remote human operator (e.g., via a remote terminal that is communicatively coupled to controller 150 via a wireless communication interface), and/or by an autonomous system (e.g., implemented by controller 150 or other control system onboard drilling rig 100, or remote from drilling rig 100 and communicatively coupled to controller 150 via a wireless communication interface). Of particular relevance to disclosed embodiments, the control may comprise controlling mast 130 (e.g., via hydraulic supports 132) to tilt drill 140 to a particular angle A with respect to reference axis R.

Figure 2:
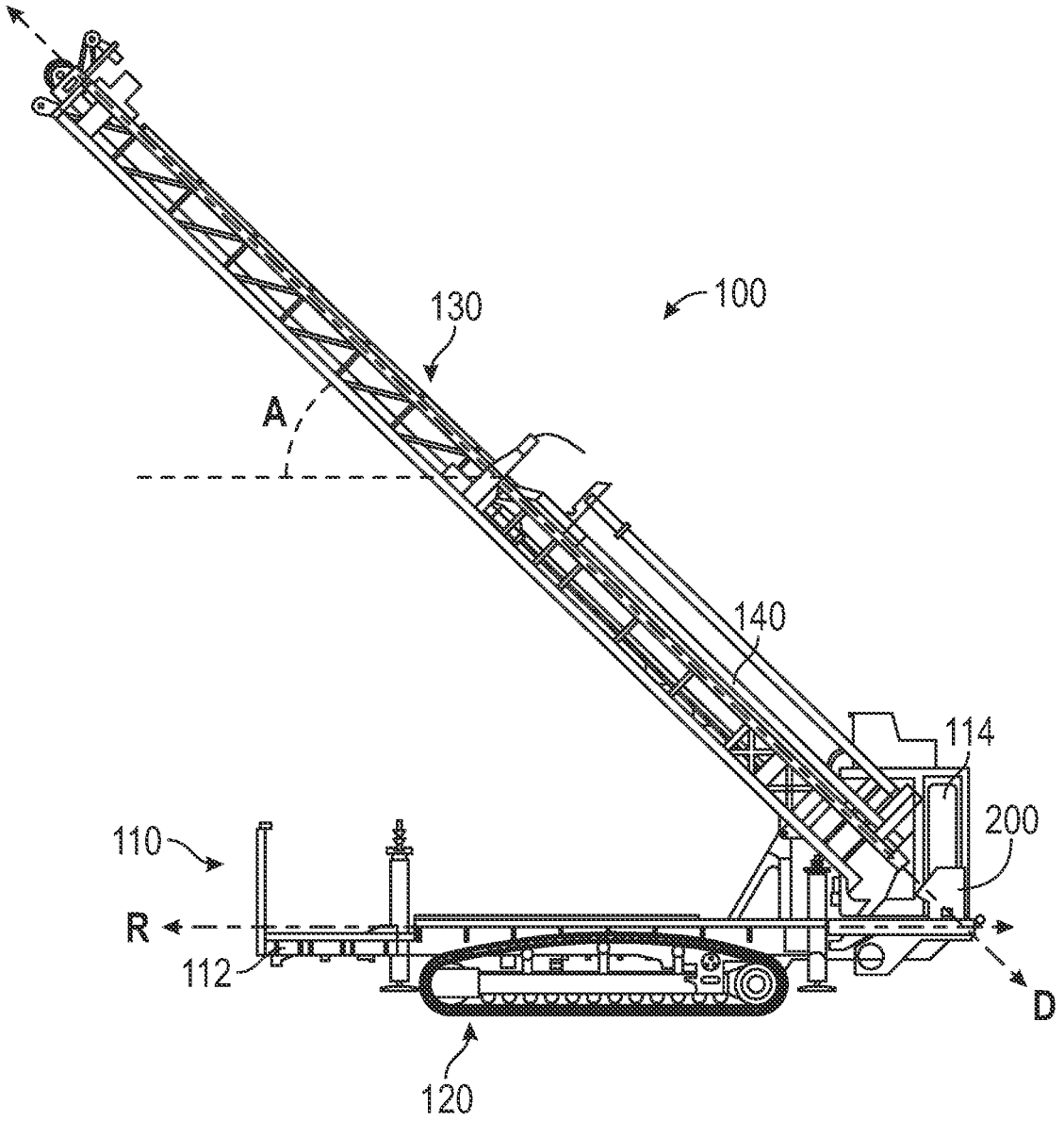
FIG. 2 illustrates a side view of a partial assembly of a drilling rig, according to an embodiment.

FIG. 2 illustrates a side view of a partial assembly of drilling rig 100, according to an embodiment. In this view, which is from the other side of drilling rig 100 as in FIG. 1, portions of machine body 110 have been removed, to more clearly illustrate components that are relevant to disclosed embodiments. As illustrated, mast 130, including drill 140 fixed therein, can be tilted to an angle A, between 0-degrees and 90-degrees (e.g., approximately 45-degrees in the illustrated example).

A magazine 200 may be attached to platform 112 of machine body 110. Magazine 200 may be positioned on platform 112, such that, when drill 140 is tilted within a sub-range of possible angles, a drill axis D of drill 140 intersects magazine 200. In an embodiment in which drill 140 tilts towards the rear of machine body 110, magazine 200 may be attached to a front end of platform 112, whereas, in an alternative embodiment in which drill 140 tilts towards the front of machine body 110, magazine 200 may be attached to a rear end of platform 112. Magazine 200 may be positioned near cabin 114, such that magazine 200 is easily accessible to a local operator of drilling rig 100. For example, magazine 200 may be positioned on a lateral side of cabin 114. As used herein, the term "lateral" should be understood to mean a horizontal orientation that is orthogonal to reference axis R.

Figure 3:
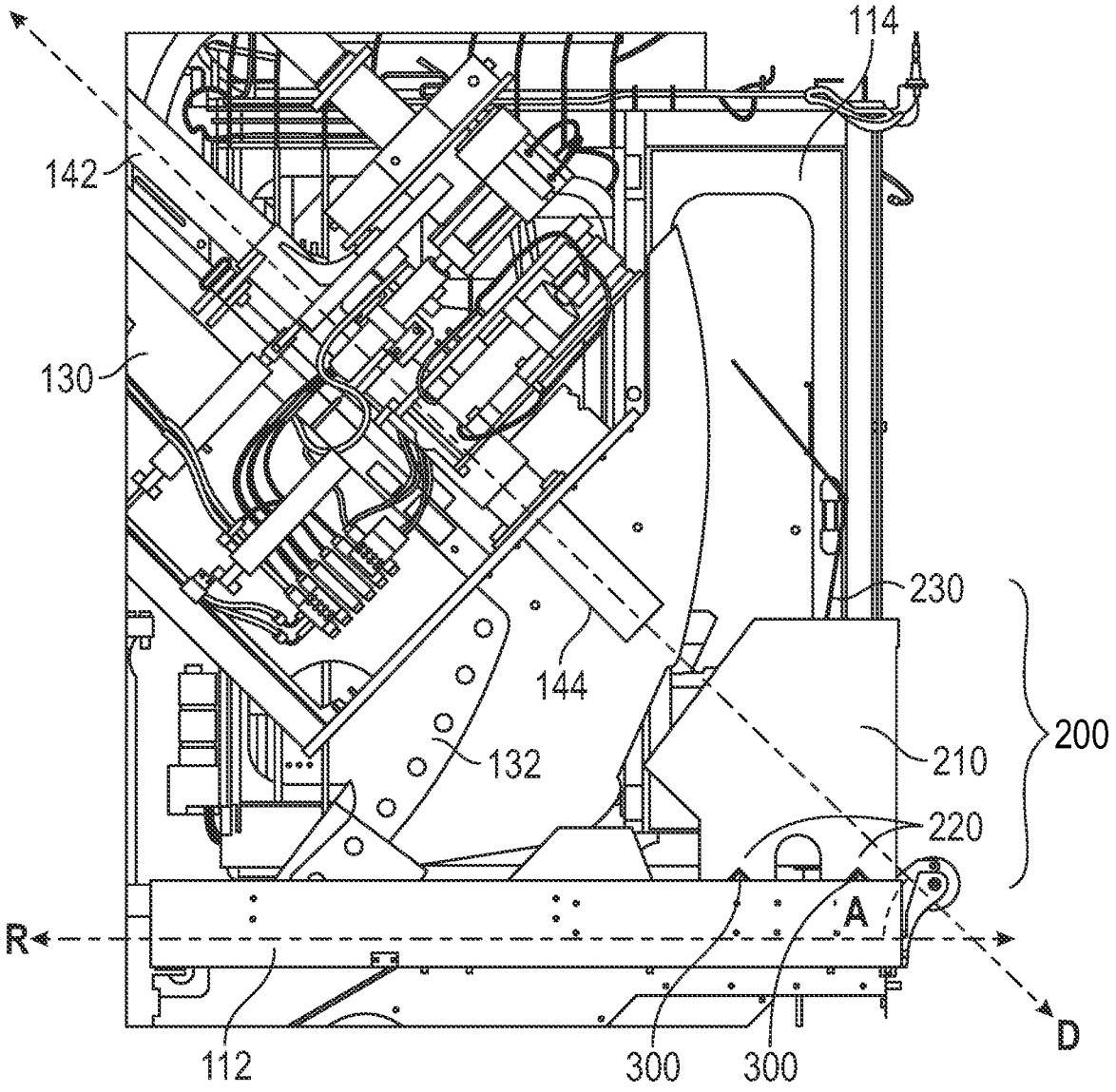
FIG. 3 illustrates a close-up side view of a partial assembly of a drilling rig, according to an embodiment.

FIG. 3 illustrates a close-up side view of a partial assembly of a drilling rig 100, according to an embodiment. Mast 130 may comprise a locking mechanism 132 that enables mast 130 to be locked at an angle A with respect to reference axis R. For example, locking mechanism 132 may comprise a plurality of lateral apertures, and platform 112 may comprise a corresponding lateral aperture (not shown), which is configured to align with each of the plurality of lateral apertures of locking mechanism 132, depending on angle A of mast 130. When the lateral aperture of platform 112 is aligned with one of the plurality of lateral apertures of locking mechanism 132, a pin may be inserted through both lateral apertures to thereby lock mast 130, and drill 140 by virtue of its fixation to mast 130, at angle A. Locking mechanism 132 may be used during normal drilling operations. However, in an embodiment, locking mechanism 132 is not used during the automated changing of drill bits.

Drill 140 may comprise a hollow hydraulically operated drill cylinder 142 that actuates a drill string 144. Drill string 144 may be configured to extend and retract parallel to drill cylinder 142, along drill axis D. Drill string 144 may extend and retract based on the pressure of hydraulic fluid, contained within drill cylinder 142, that is applied to the end of drill string 144 through a wire rope and sheave mechanism or any other suitable mechanism. This hydraulic pressure and/or the travel of drill string 144 may be controlled by controller 150.

Within a sub-range of angles, drill axis D may intersect with magazine 200. Thus, when angle A of drill 140 is within this sub-range of angles, drill string 144 may be extended towards magazine 200 to interact with magazine 200 and/or retracted away from magazine 200 when the interaction with magazine 200 is completed. In this manner, drill string 144 may be operated to release used drill bits into magazine 200 and engage new drill bits held within magazine 200.

Magazine 200 is configured to hold a plurality of drill bits for the automated changing of drill bits on drilling rig 100. Magazine 200 may comprise a housing 210, one or more engagement members 220, and/or a magazine lid 230. In an alternative embodiment, magazine may consist of just housing 210, housing 210 and one or more engagement members 220, or housing 210 and magazine lid 230. Housing 210 may comprise a plurality of drill-bit pockets (not shown), with each drill-bit pocket configured to hold a drill bit.

Housing 210 may be supported on platform 112 via engagement member(s) 220. Engagement member(s) 220 may comprise two laterally extending legs on the bottom of housing 210 or four legs on each corner of housing 210. Alternatively, engagement member(s) 220 may comprise other means for attaching or otherwise engaging housing 210 with platform 112. In an alternative embodiment, engagement member(s) 220 may be omitted, in which case housing 210 may be mounted directly on platform 112. In any case, engagement member(s) 220 and/or another mechanism of magazine 200 may be configured to fix housing 210 to platform 112 of drilling rig 100.

In an embodiment, engagement member(s) 220 may engage with one or more rails 300. Each rail 300 may be oriented along a lateral axis that is horizontal and orthogonal to reference axis R. Engagement member(s) 220 may be configured to slidably engage (e.g., attach) magazine 200 with the rail(s) 300, such that magazine 200 can slide laterally along rail(s) 300. In this case, magazine 200 may be controllable by controller 150 to slide along rail(s) 300 in both directions along the lateral axis. For example, controller 150 could control the hydraulic pressure in a hydraulic piston that extends and retracts laterally and is connected to magazine 200, so as to respectively push and pull magazine 200, on rail(s) 300, along the lateral axis. It should be understood that sliding magazine 200 along rail(s) 300 will change the point of intersection between drill axis D and magazine 200 along the lateral axis.

In the illustrated embodiment, engagement member(s) 220 are at least two engagement members 220 spaced apart along reference axis R, and rail(s) 300 are at least two rails 300 spaced apart along reference axis R. In an alternative embodiment, there may be only a single engagement member 220 and a single rail 300, or three or more engagement members 220 and three or more rails 300. In any case, each engagement member 220 is configured to slidably engage with a respective one of rail(s) 300. For example, each engagement member 220 may be seated around the respective rail 300, along reference axis R, so as to prevent translation of engagement member 220 along reference axis R, and/or attached to rail 300 to prevent vertical translation of engagement member 220.

Magazine lid 230 may be configured to open to provide access to an open end of each of the plurality of drill-bit pockets within housing 210, and close to prevent access to the open end of each of the plurality of drill-bit pockets within housing 210. When closed, magazine lid 230 may protect the drill bits, held in housing 210, from environmental elements, such as dust, debris, and/or the like, damage from other mechanical components of drilling rig 100, and/or the like. When opened, drill string 144 has access to the drill-bit pockets within housing 210. In an alternative embodiment, magazine lid 230 may be omitted, such that the drill-bit pockets of housing 210 are always exposed.

Figure 4:
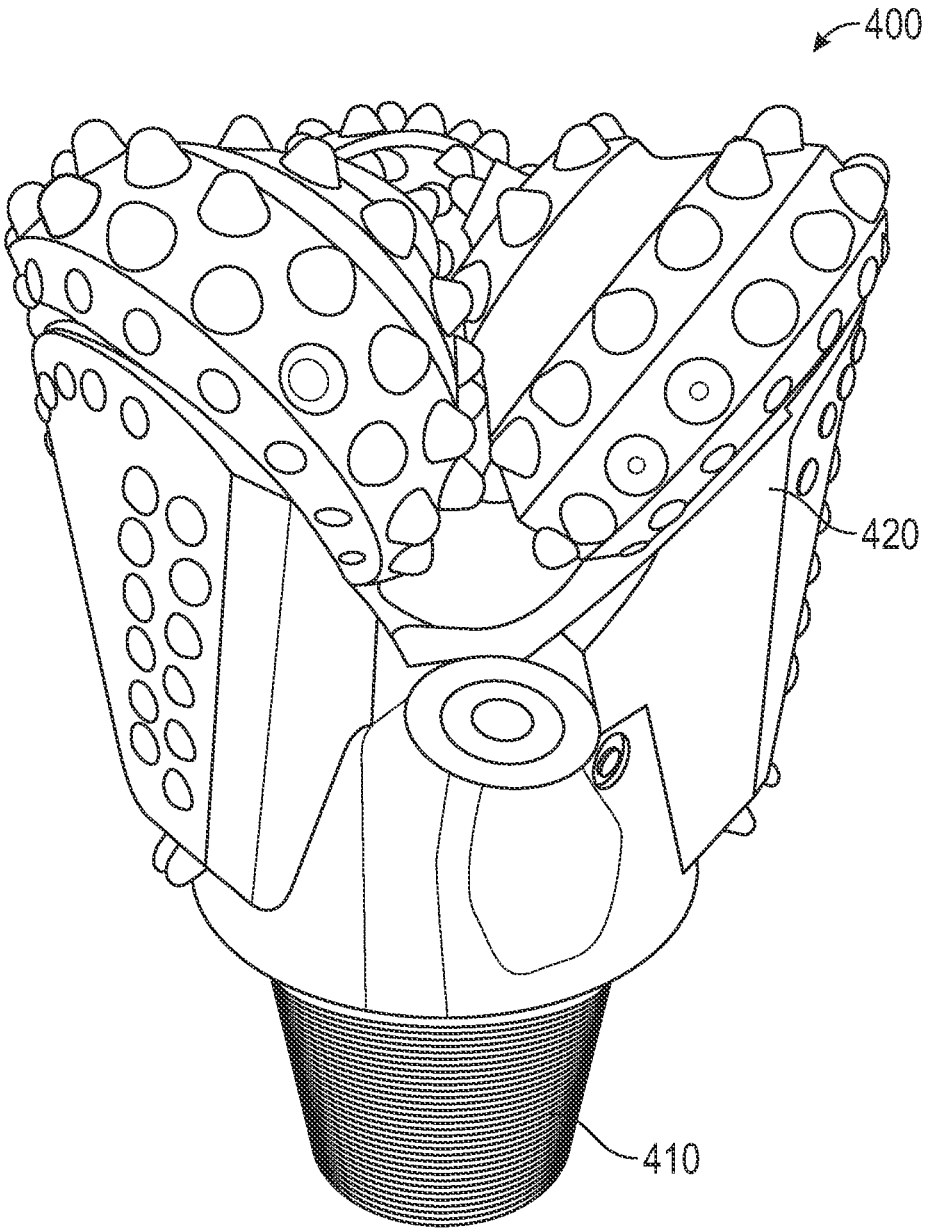
FIG. 4 illustrates a drill bit, according to an example.

FIG. 4 illustrates a drill bit 400, according to an example. Each drill bit 400 comprises an engagement end 410 and a drilling end 420. Engagement end 410 may be configured to engage with drill string 144. In particular, engagement end 410 may comprise a shank that is configured to be inserted within a socket on the drilling end of drill string 144. Alternatively, engagement end 410 could comprise a socket that is configured to receive the drilling end of drill string 144. In either case, an attachment and/or release mechanism may be used to respectively fix drill bit 400 to drill string 144 and unfix drill bit 400 from drill string 144. Any suitable mechanism may be used as the attachment and/or release mechanism.

In the illustrated embodiment, drilling end 420 comprises three rotating teeth. However, it should be understood that drilling end 420 of drill bit 400 may comprise any suitable mechanism(s) for drilling into a material surface. Different types of drill bits 400 may be specifically suited for different uses or materials. For example, one type of drill bit 400 may differ from another type of drill bit 400 in terms of size, drilling mechanism, and/or the like. Disclosed embodiments may operate with the same type of drill bit 400 or different types of drill bits 400.

Figure 5:
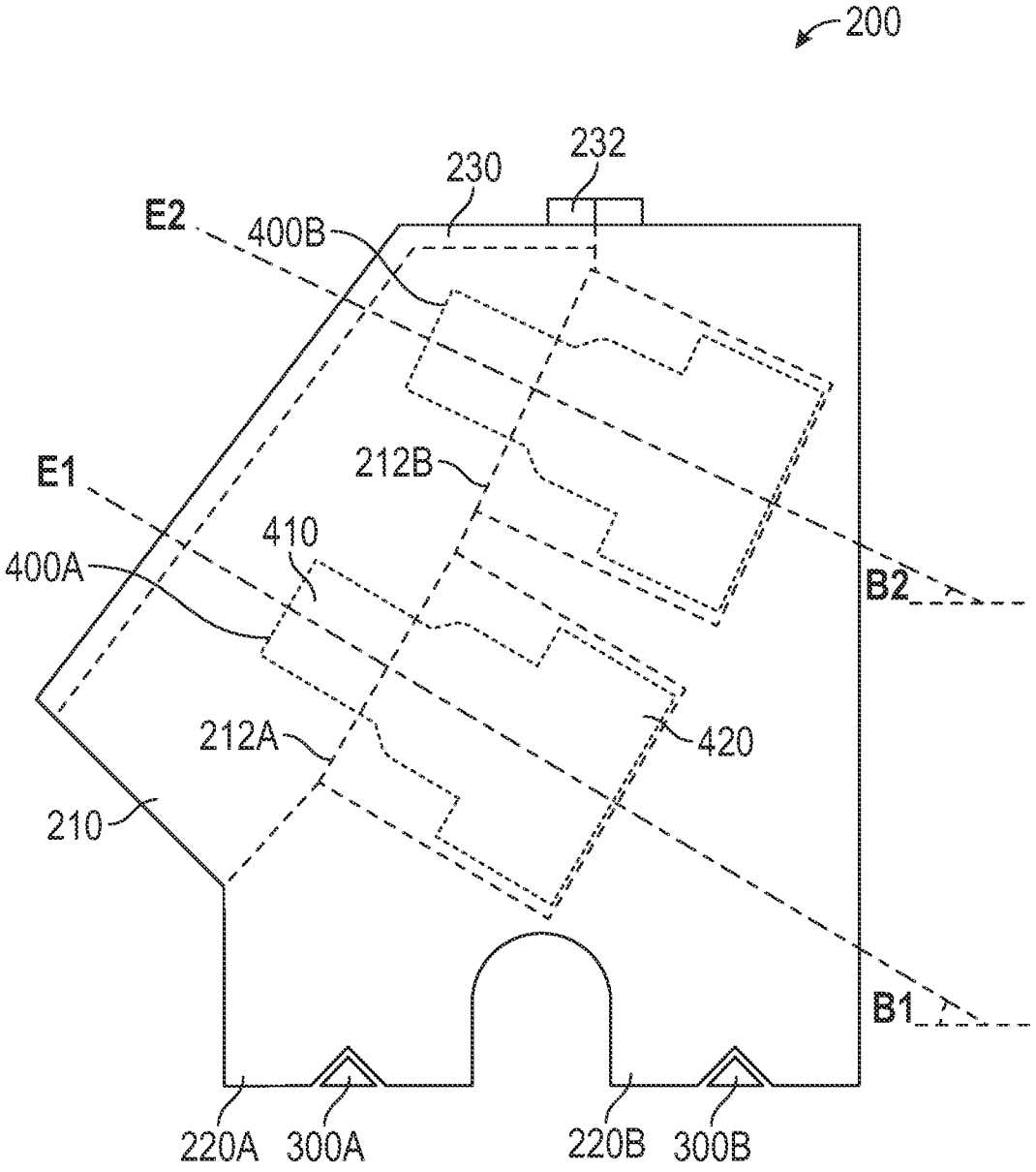
FIGS. 5 and 6 illustrate a magazine for drill bits, according to alternative embodiments.

FIG. 5 illustrates magazine 200 for drill bits 400, according to a first embodiment. In this embodiment, magazine 200 comprises a housing 210, at least two engagement members 220, illustrated as engagement members 220A and 220B, and a magazine lid 230 that is configured to open and close via a hinge 232 or other mechanism. As discussed elsewhere herein, engagement members 220 may be configured to slidably engage with rails 300. For example, engagement member 220A is configured to slide along rail 300A, and engagement member 220B is configured to slide along rail 300B.

Housing 210 of magazine 200 comprises at least one column of two or more drill-bit pockets 212, illustrated as first drill-bit pocket 212A and second drill-bit pocket 212B. As used herein, the term "column" refers to a plurality of vertically arranged drill-bit pockets 212. A vertical axis is one that is orthogonal to a plane of platform 112. Within a column, each drill-bit pocket 212 is at a different vertical position than any other drill-bit pocket 212. It should be understood that the drill-bit pockets 212 within a column may all be centered on the same vertical axis or may be offset from each other along reference axis R, so as to be centered on different vertical axes. In the illustrated embodiment, drill-bit pockets 212 are offset along reference axis R, so as to be centered on different vertical axes.

Each drill-bit pocket 212 has a closed end and an open end, and is configured to receive at least a portion of drilling end 420 of drill bit 400, such that engagement end 410 of drill bit 400 is accessible at the open end of that drill-bit pocket 212. At least a portion of engagement end 410 of drill bit 400 may protrude from drill-bit pocket 212, and/or the diameter of drill-bit pocket 212 may be large enough to accommodate the outer diameter of the drilling end of drill string 144, such that drill string 144 can access engagement end 410 of drill bit 400 within drill-bit pocket 212. In either case, the drilling end of drill string 144 is able to access engagement end 410 of each drill bit 400 held in magazine 200.

Each drill-bit pocket 212 may be configured to, when holding a drill bit 400, align the drill bit with a respective engagement axis E that is angled at a non-zero angle B with respect to reference axis R. For example, each drill-bit pocket 212 may be a cylindrical space that is itself oriented at angle B with respect to reference axis R, such that, when a drill bit 400 is inserted within drill-bit pocket 212, the longitudinal axis of drill bit 212 becomes coincident with a respective engagement axis E of drill-bit pocket 212. In other words, when a drill bit 400 is held within drill-bit pocket 212, drill bit 400 is oriented along the engagement axis E of the drill-bit pocket 212, such that engagement end 410 of drill bit 400 is angled at an angle B with respect to reference axis R. The engagement axis E of a drill-bit pocket 212 represents the axis along which drill string 144 can properly engage with an engagement end 410 of a drill bit 400 held within the drill-bit pocket 212.

Within each column of drill-bit pockets 212, each drill-bit pocket 212 may angle a respective drill bit 400, held within, at a different angle B with respect to reference axis R than any other drill-pocket 212 in the same column. In other words, within the column, the engagement axis E of each drill-bit pocket 212 may have a different angle B than the engagement axis E of any other drill-bit pocket 212 within the same column. In general, the angles B of the plurality of drill-bit pockets 212 in a column will decrease from the bottom to the top of the column. In other words, the angle B of the drill-bit pocket 212 at the bottom of the column (i.e., closest to platform 112) will be the largest angle for the column, and the angle B of the drill-bit pocket 212 at the top of the column (i.e., farthest from platform 112) will be the smallest angle for the column, with the angles B of any drill-bit pockets 212 between the bottom and top drill-bit pockets 212 being incrementally between the largest and smallest angles.

As an example, first drill-bit pocket 212A has a first engagement axis E1, which has a first angle B1 with respect to reference axis R, and second drill-bit pocket 212B has a second engagement axis E2, which has a second angle B2 with respect to reference axis R. First drill-bit pocket 212A is positioned vertically below second drill-bit pocket 212B, within the same column. First drill-bit pocket 212A holds a first drill bit 400A at the first angle B1, for example, by being angled at the first angle B1 with respect to reference axis R. Similarly, second drill-bit pocket 212B holds a second drill bit 400B at the second angle B2, for example, by being angled at the second angle B2 with respect to reference axis R. Notably, since second drill-bit pocket 212B is positioned vertically above first drill-bit pocket 212A, second angle B2 is smaller than first angle B1.

Each drill-bit pocket 212 in magazine 200 may have the same size and shape as every other drill-bit pocket 212, but may be angled differently than other drill-bit pocket(s) 212 in the same column. Alternatively, one or more drill-bit pockets 212 may have a different size and shape than one or more other drill-pockets 212 within the same magazine 200.

In an embodiment, each drill-bit pocket 212 is configured to hold the same type of drill bit 400. In other words, magazine 200 may hold drill bits 400 of a single type. In an alternative embodiment, magazine 200 holds drill bits 400 of different types. In this case, each of one or more of the plurality of drill-bit pockets 212 in magazine 200 may be configured to hold a different type of drill bit 400 than at least one other one of the plurality of drill-bit pockets 212 in magazine 200. It should be understood that drill bits 400 of different types may have different uses. For example, a drill bit 400 of a first type may be configured to drill through a different type of material than a drill bit 400 of a second type, drill a larger hole than a drill bit 400 of the second type, and/or the like.

While magazine 200 is illustrated with a column consisting of two drill-bit pockets 212, it should be understood that each column in magazine 200 may comprise any feasible number of drill-bit pockets 212, including three or more vertically arranged drill-bit pockets 212. For example, magazine 200 may be expanded in height and/or width to include one or more additional drill-bit pockets 212, positioned below first drill-bit pocket 212A and/or above second drill-bit pocket 212B within the column.

Magazine 200 may consist of a single column of drill-bit pockets 212. Alternatively, in an embodiment comprising rail(s) 300 or another mechanism for laterally sliding magazine 200, magazine 200 may comprise a plurality of columns of drill-bit pockets 212. In this case, magazine 200 will comprise both lateral rows and vertical columns of drill-bit pockets 212, with each row comprising two or more drill-bit pockets 212 and each column comprising two or more drill-bit pockets 212. Within a row, each drill-bit pocket 212 in the row may hold a drill bit 400 at the same angle B as every other drill-bit pocket 212 in that row. Conversely, within a column, each drill-bit pocket 212 in the column may hold a drill bit 400 at a different angle B than every other drill-bit pocket 212 in that column, with lower drill-bit pockets 212 in the column having a larger angle B than higher drill-bit pockets 212 in the column.

Figure 6:
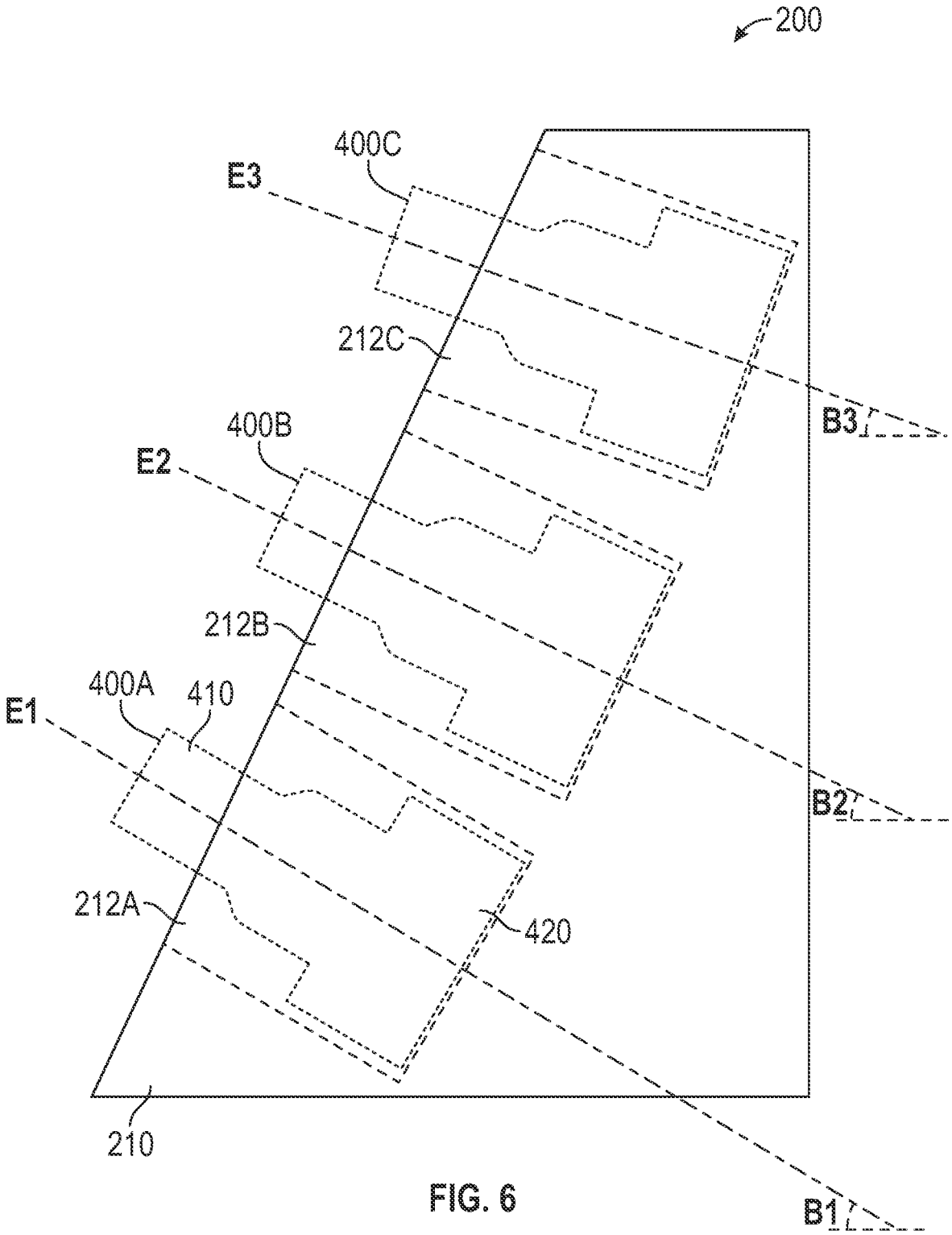

FIG. 6 illustrates magazine 200 for drill bits 400, according to a second embodiment. In this embodiment, magazine 200 does not comprise distinct engagement members 220 or a magazine lid 230. In other words, magazine 200 may consist of just housing 210. In this case, magazine 200 may be simpler to manufacture and maintain. In an alternative embodiment, magazine 200 could comprise one or more engagement members 220 (e.g., which slidably engage with one or more rails 300) and/or magazine lid 230, as in the first embodiment.

In every other respect, magazine 200 may be similar or identical to magazine 200 of the first embodiment. Thus, any description of the columns of drill-bit pockets 212 and the drill-bit pockets 212 themselves, with respect to the first embodiment, applies equally to this second embodiment. For example, magazine 200 may comprise at least one column that includes a plurality of drill-bit pockets 212 that are each configured to receive at least a portion of a drilling end 420 of a drill bit 400, such that engagement end 410 of the drill bit 400 is accessible at the open end of that drill-bit pocket 212. In addition, within each column of drill-bit pockets 212, each drill-bit pocket 212 may angle a respective drill bit 400, held within, at a different angle B with respect to reference axis R than any other drill-pocket 212 in the same column.

In the illustrated example, first drill-bit pocket 212A has a first engagement axis E1, which has a first angle B1 with respect to reference axis R, second drill-bit pocket 212B has a second engagement axis E2, which has a second angle B2 with respect to reference axis R, and third drill-bit pocket 212C has a third engagement axis E3, which has a third angle B3 with respect to reference axis R. First drill-bit pocket 212A is positioned vertically below second drill-bit pocket 212B, and second drill-bit pocket 212B is positioned vertically below third drill-bit pocket 212C, within the same column. First drill-bit pocket 212A holds a first drill bit 400A at the first angle B1, for example, by being angled at the first angle B1 with respect to reference axis R, second drill-bit pocket 212B holds a second drill bit 400B at the first angle B2, for example, by being angled at the second angle B2 with respect to reference axis R, and third drill-bit pocket 212C holds a third drill bit 400C at the third angle B3, for example, by being angled at the third angle B3 with respect to reference axis R. Notably, third angle B3 is smaller than second angle B2, which is smaller than first angle B1.

Figure 7:
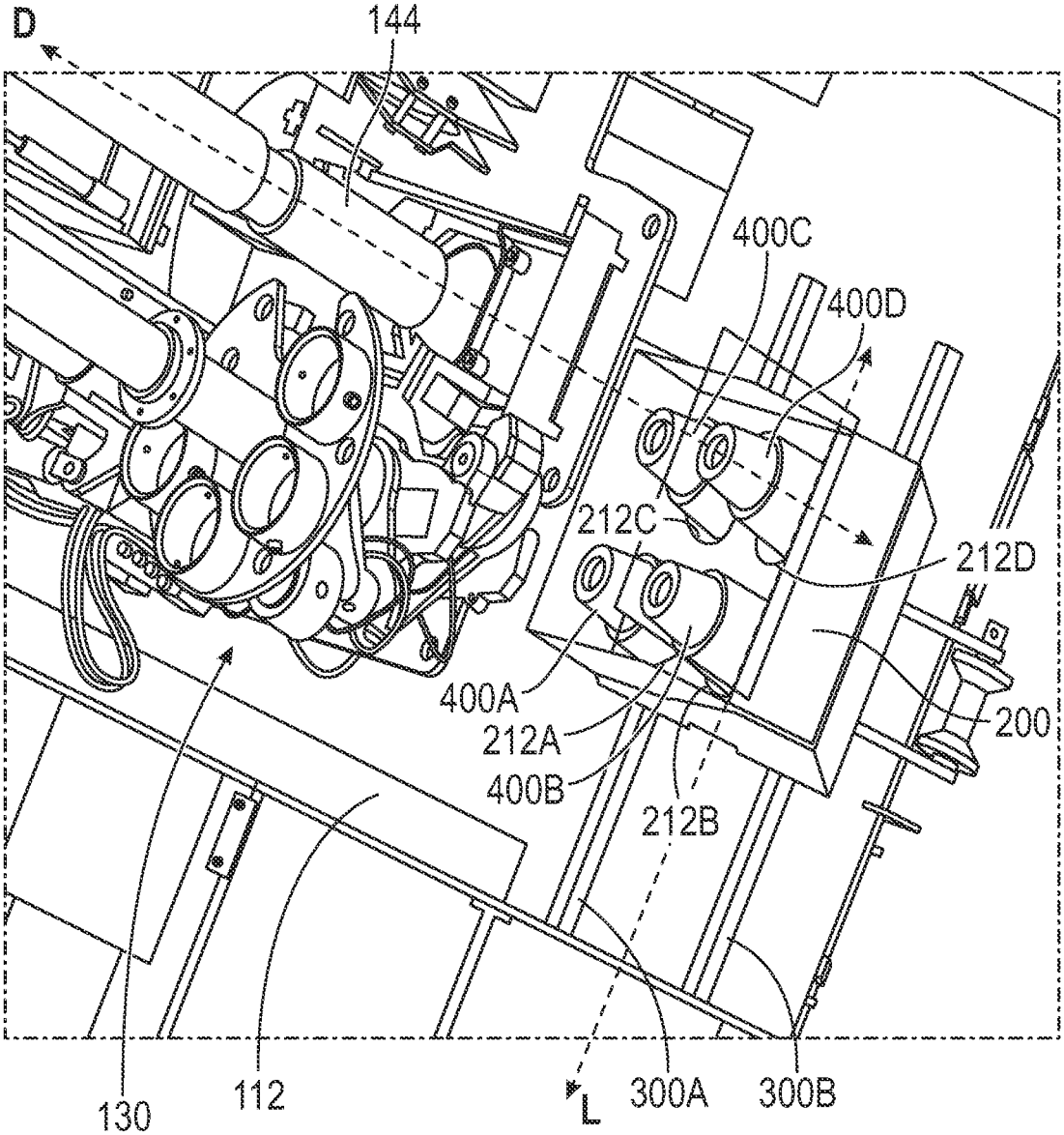
FIG. 7 illustrates an assembly for automated changing of drill bits, according to an embodiment.

FIG. 7 illustrates an assembly for automated changing of drill bits 400, according to an embodiment. In the illustrated example, magazine 200 comprises two columns of drill-bit pockets 212, illustrated as a first column comprising drill-bit pockets 212A and 212B and a second column comprising drill-bit pockets 212C and 212D. Each drill-bit pocket 212 holds a respective drill bit 400, illustrated as drill bits 400A, 400B, 400C, and 400D, with drilling end 420 positioned within drill-bit pocket 212 and engagement end 410 protruding out of drill-bit pocket 212, so as to be engageable by drill string 144.

The plurality of drill-bit pockets 212 in magazine 200 may comprise two or more rows of laterally arranged drill-bit pockets 212. In the illustrated embodiment, magazine 200 consists of two rows of drill-bit pockets 212, extending along a lateral axis L. These rows are illustrated as a first row comprising drill-bit pockets 212A and 212C and a second row comprising drill-bit pockets 212B and 212D, with the second row positioned vertically above the first row. In the first row, all of the drill-bit pockets 212 (i.e., 212A and 212C in the illustrated embodiment) hold drill bits 400 (i.e., 400A and 400C in the illustrated embodiment) at a first angle, and, in the second row, all of the drill-bit pockets 212 (i.e., 212B and 212D in the illustrated embodiment) hold drill bits 400 (i.e., 400B and 400D in the illustrated embodiment) at a second angle. The second angle is smaller than the first angle.

As discussed elsewhere herein, mast 130 is configured to rotate or tilt drill 140 between a range of angles with respect to reference axis R, including the first angle and the second angle, for example, by itself tilting between the range of angles, under the control of controller 150. During the changing of a drill bit 400, controller 150 may control mast 130 to tilt drill 140 to the first angle to align drill axis D with engagement axis E1 of the drill-bit pocket 212 (e.g., 212A or 212C) in the first row, or to the second angle to align drill axis D with engagement axis E2 of the drill-bit pocket 212 (e.g., 212B or 212D) in the second row. In addition, in an embodiment with a plurality of columns of drill-bit pockets 212, controller 150 may control magazine 200 to slide along rail(s) 300, so as to align drill axis D with a particular column. Thus, controller 150 may control the angle of drill 140 and/or the lateral position of magazine 200 to align drill axis D with the engagement axis E of any one of the plurality of drill-bit pockets 212 in magazine 200. In addition, in an embodiment of magazine 200 that comprises magazine lid 230, controller 150 may control magazine lid 230 to switch between open and closed positions.

The selection of the angle of drill axis D represents the selection of a particular row of drill-bit pockets 212, and the selection of the lateral position of magazine 200 represents the selection of a particular column of drill-bit pockets 212. It should be understood that the selection of a particular row and a particular column defines the intersection point of drill axis D with magazine 200 and thereby represents the selection of a particular drill-bit pocket 212. In the illustrated example, drill axis D is aligned with the engagement axis E of drill-bit pocket 212D.

Once drill axis D has been aligned with a particular engagement axis E of a particular drill-bit pocket 212, drill string 144 may be operated to interact with that particular drill-bit pocket 212, under the control of controller 150. In the illustrated example, drill axis D is aligned with the engagement axis E of drill-bit pocket 212D, and therefore, drill string 144 may be operated to interact with drill-bit pocket 212D. If the selected drill-bit pocket 212D is occupied by a drill bit 400 (e.g., a new drill bit 400) and no drill bit 400 is currently installed on the drilling end of drill string 144, this interaction may comprise extending drill string 144 until the drilling end of drill string 144 engages with engagement end 410 of the drill bit 400 occupying drill-bit pocket 212D, and then fixing the drill bit 400 in drill-bit pocket 212D to the drilling end of drill string 144 via an attachment mechanism, to thereby install the drill bit 400 on the drill string 144. In this case, drill string 144 may then be retracted, and mast 130 and/or drill 140 may be controlled to begin a drilling operation with the installed drill bit 400. On the other hand, if the selected drill-bit pocket 212D is empty and a drill bit 400 (e.g., a used drill bit 400) is currently installed on the drilling end of drill string 144, this interaction may comprise extending drill string 144 until drilling end 420 of the drill bit 400 is within drill-bit pocket 212D, and then releasing the drill bit 400 from drill string 144 into drill-bit pocket 212D via a release mechanism. In this case, drill string 144 may then be retracted, and mast 130, drill 140, and/or magazine 200 may be controlled to install a new drill bit 400 on the drilling end of drill string 144, as described above.

Figure 8:
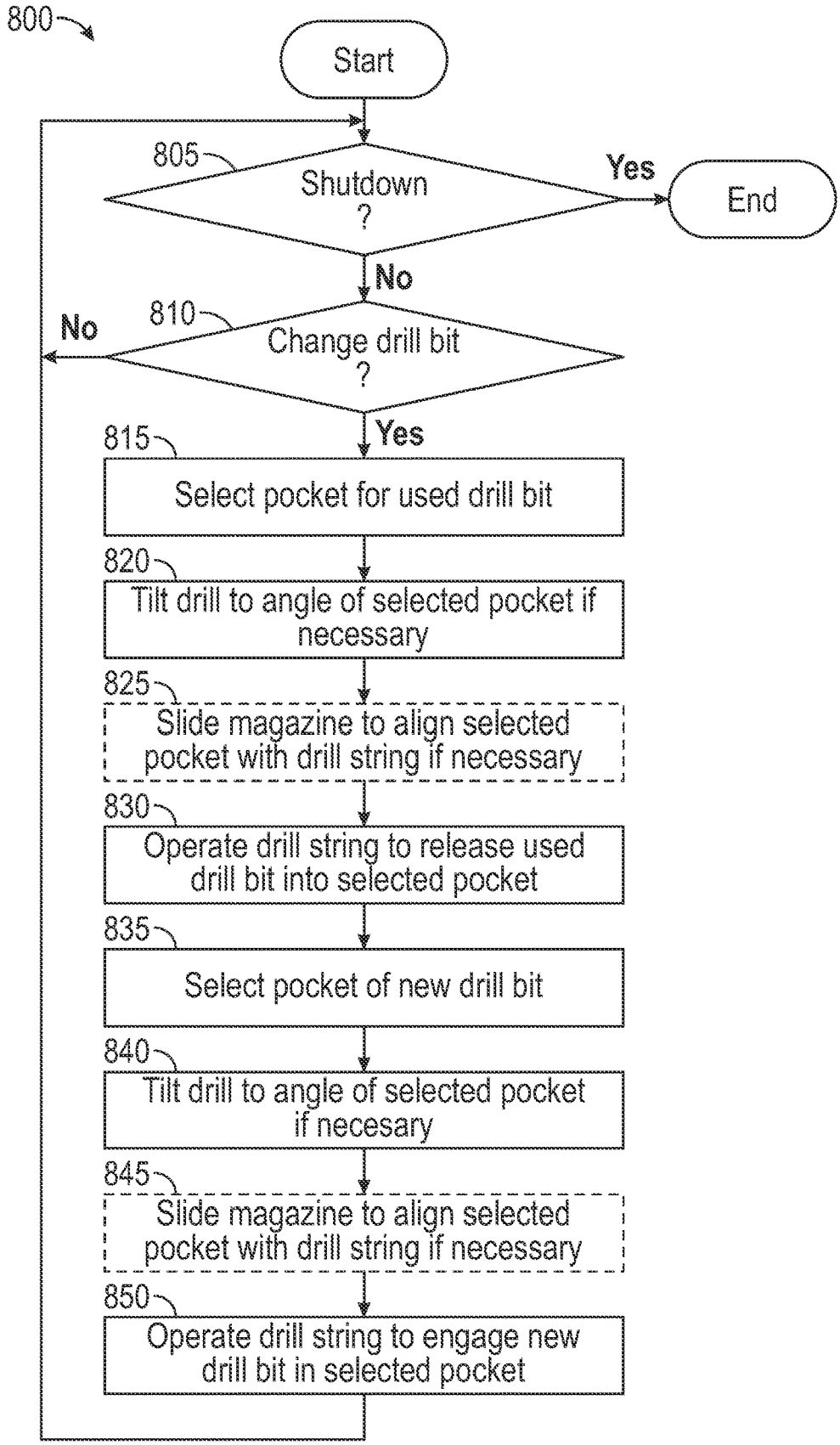
FIG. 8 illustrates a process for the automated changing of drill bits, according to an embodiment.

FIG. 8 illustrates a process 800 for the automated changing of drill bits 400, according to an embodiment. Process 800 may be implemented by controller 150 in software, hardware, or a combination of software and hardware. While process 800 is illustrated with a certain arrangement and ordering of subprocesses, process 800 may be implemented with fewer, more, or different subprocesses and a different arrangement and/or ordering of subprocesses. In addition, it should be understood that any subprocess, which does not depend on the completion of another subprocess, may be executed before, after, or in parallel with that other independent subprocess, even if the subprocesses are described or illustrated in a particular order.

In an embodiment, process 800 starts when drilling rig 100 is turned on and continues to operate (e.g., in the background) for as long as drilling rig 100 is operating. When drilling rig is shutdown (i.e., "Yes" in subprocess 805), process 800 may end. Otherwise, for as long as drilling rig 100 remains operational (i.e., "No" in subprocess 805), process 800 may proceed to subprocess 810.

In subprocess 810, process 800 may determine whether or not to change a drill bit 400, such as a used drill bit 400 that is currently installed on drill string 144. For example, controller 150 may determine to change drill bit 400 in response to one or more triggers. Examples of a trigger include, without limitation, receiving a user operation (e.g., input) from a local operator (e.g., via a machine control in cabin 114) or remote operator (e.g., via an input at a remote terminal), receiving a control command from an autonomous system (e.g., onboard drilling rig 100 or remote from drilling rig 100), detecting a change in status of the drill bit 400 that is currently installed on drill string 144 (e.g., indicating that drill bit 400 is at the end of its useful life or indicating another problem or issue with drill bit 400), detecting a local event at drilling rig 100 (e.g., the expiration of a timer, a change in the material being drilled, a change in the drilling operation being performed, etc.), and/or the like. When determining not to change drill bit 400 (i.e., "No" in subprocess 810), process 800 may return to subprocess 805 and await a determination to change drill bit 400 in subprocess 810. Otherwise, when determining to change drill bit 400 (i.e., "Yes" in subprocess 810), process 800 may proceed to subprocess 815. In particular, in response to the determination to change drill bit 400 (i.e., "Yes" in subprocess 810), an iteration of subprocesses 815-850 (or an implemented subset of subprocesses 815-850) may be performed.

In subprocess 815, process 800 may determine a drill-bit pocket 212 for the drill bit 400 that is currently installed on drill string 144. For example, controller 150 may maintain a record (e.g., a table in memory) of the status of each drill-bit pocket 212 in magazine 200. The status of each drill-bit pocket 212 may comprise an indication of whether the drill-bit pocket 212 is empty or occupied with a drill bit 400, the type of drill bit 400 held by the drill-bit pocket 212 (if occupied), and/or the like. Controller 150 may select an empty one of the plurality of drill-bit pockets 212 in magazine 200 based on the record. If there are multiple empty drill-bit pockets 212, any suitable selection technique may be used. For example, controller 150 may select one of the empty drill-bit pockets 212 at random, based on a user input (e.g., from a local or remote operator), based on which of the empty drill-bit pockets 212 has been empty the longest or least amount of time, based on an ordering of the drill-bit pockets 212, based on the type of drill bit 400 currently installed on drill string 144, or the like. In the event that there are no empty drill-bit pockets 212 in magazine 200, controller 150 may generate an alert (e.g., an error message or other indication provided to a local or remote operator of drilling rig 100, an error message returned to an autonomous system that requested the change in drill bit 400, etc.).

In subprocess 820, process 800 may tilt drill 140 to an angle, with respect to reference axis R, that matches the angle of the empty drill-bit pocket 212 that was selected in subprocess 815. In particular, controller 150 may control mast 130 to tilt drill 140, such that drill axis D has the same angle, with respect to reference axis R, as the engagement axis E of the selected drill-bit pocket 212. It should be understood that, if drill 140 is already tilted to the angle of the selected drill-bit pocket 212, subprocess 820 may simply maintain drill 140 at this angle. In an embodiment, locking mechanism 132 is not used to secure angle A of drill 140 during subprocess 820.

In an embodiment in which magazine 200 comprises two or more columns of drill-bit pockets 212, subprocess 825 slides magazine 200 to align the empty drill-bit pocket 212, that was selected in subprocess 815, with drill string 144. In particular, controller 150 may control magazine 200 to slide on rail(s) 300 along lateral axis L, such that the column, in which the selected drill-bit pocket 212 is comprised, intersects with drill axis D. It should be understood that, if magazine 200 is already positioned such that the column of the selected drill-bit pocket 212 intersects with drill axis D, subprocess 825 may simply maintain magazine 200 at its current position.

It should be understood that, in an embodiment in which magazine 200 comprises two or more columns of drill-bit pockets 212, the combination of subprocesses 820 and 825 will align drill axis D with the engagement axis E of the empty drill-bit pocket 212 that was selected in subprocess 815. However, in an embodiment in which magazine 200 is stationary and consists of a single column of drill-bit pockets 212, subprocess 820 will have necessarily aligned drill axis D with the engagement axis E of the selected drill-bit pocket 212. Thus, in this embodiment, subprocess 825 can be omitted.

In subprocess 830, drill string 144 may be operated to release the drill bit 400 (e.g., used drill bit 400), currently installed on the drilling end of drill string 144, into the drill-bit pocket 212 that was selected in subprocess 815 and whose engagement axis E was aligned with drill axis D in subprocesses 820 and/or 825. In particular, controller 150 may control drill 140 to extend drill string 144 outward from drill cylinder 142 along drill axis D towards the selected drill-bit pocket 212, until drilling end 420 of drill bit 400 is held within the selected drill-bit pocket 212, then actuating a release mechanism that releases drill bit 400 from drill string 144 into the selected drill-bit pocket 212, and then retracting drill string 144 back into drill cylinder 142 along drill axis D away from the selected drill-bit pocket 212. During this operation, controller 150 may determine that the drilling end 420 of drill bit 400 is held within the selected drill-bit pocket 212 based on a fixed extension distance of the drilling end of drill string 144 from drill cylinder 142, a pressure sensor that detects the contact of drill bit 400 with the closed end of the selected drill-bit pocket 212, or in any other suitable manner. The release mechanism may comprise disengaging mated corresponding components on the drilling end of drill string 144 and engagement end 410 of drill bit 400. It should be understood that, once drill string 144 has released drill bit 400 into the selected drill-bit pocket 212, the drilling end of drill string 144 will be free to engage with another drill bit 400.

In subprocess 835, process 800 may determine a drill-bit pocket 212 that is currently holding a drill bit 400 to be installed on drill string 144. For example, controller 150 may select an occupied one of the plurality of drill-bit pockets 212 in magazine 200 based on a record comprising the status of each drill-bit pocket 212. If there are multiple occupied drill-bit pockets 212, any suitable selection technique may be used. For example, controller 150 may select one of the occupied drill-bit pockets 212 at random, based on a user input (e.g., from a local or remote operator), based on which of the occupied drill-bit pockets 212 has been occupied the longest or least amount of time, based on an ordering of the drill-bit pockets 212, based on the type of drill bit 400 held in each occupied drill-bit pocket 212, or the like. In the event that there are no occupied drill-bit pockets 212 in magazine 200, controller 150 may generate an alert (e.g., an error message or other indication provided to a local or remote operator of drilling rig 100, an error message returned to an autonomous system that requested the change in drill bit 400, etc.).

In subprocess 840, process 800 may tilt drill 140 to an angle, with respect to reference axis R, that matches the angle of the occupied drill-bit pocket 212 that was selected in subprocess 835. In particular, controller 150 may control mast 130 to tilt drill 140, such that drill axis D has the same angle, with respect to reference axis R, as the engagement axis E of the selected drill-bit pocket 212. It should be understood that, if drill 140 is already tilted to the angle of the selected drill-bit pocket 212, subprocess 840 may simply maintain drill 140 at this angle. In an embodiment, locking mechanism 132 is not used to secure angle A of drill 140 during subprocess 840.

In an embodiment in which magazine 200 comprises two or more columns of drill-bit pockets 212, subprocess 845 slides magazine 200 to align the occupied drill-bit pocket 212, that was selected in subprocess 835, with drill string 144. In particular, controller 150 may control magazine 200 to slide on rail(s) 300 along lateral axis L, such that the column, in which the selected drill-bit pocket 212 is comprised, intersects with drill axis D. It should be understood that, if magazine 200 is already positioned such that the column of the selected drill-bit pocket 212 intersects with drill axis D, subprocess 845 may simply maintain magazine 200 at its current position.

It should be understood that, in an embodiment in which magazine 200 comprises two or more columns of drill-bit pockets 212, the combination of subprocesses 840 and 845 will align drill axis D with the engagement axis E of the occupied drill-bit pocket 212 that was selected in subprocess 835. However, in an embodiment in which magazine 200 is stationary and consists of a single column of drill-bit pockets 212, subprocess 840 will have necessarily aligned drill axis D with the engagement axis E of the selected drill-bit pocket 212. Thus, in this embodiment, subprocess 845 can be omitted.

In subprocess 850, drill string 144 may be operated to engage the drill bit 400 (e.g., new drill bit 400), held by the occupied drill-bit pocket 212 that was selected in subprocess 835 and whose engagement axis E was aligned with drill axis D in subprocesses 840 and/or 845. In particular, controller 150 may control drill 140 to extend drill string 144 outward from drill cylinder 142 along drill axis D towards the selected drill-bit pocket 212, until the drilling end of drill string 144 engages with engagement end 410 of drill bit 400 held within the selected drill-bit pocket 212, then actuating an attachment mechanism that attaches the engaged drill bit 400 to drill string 144, and then retracting drill string 144 back into drill cylinder 142 along drill axis D away from the selected drill-bit pocket 212. During this operation, controller 150 may determine that the drilling end of drill string 144 has engaged with engagement end 410 of drill bit 400 held within the selected drill-bit pocket 212 based on a fixed extension distance of the drilling end of drill string 144 from drill cylinder 142, a pressure sensor that detects the contact of drill string 144 with engagement end 410 of drill bit 400, or in any other suitable manner. The attachment mechanism may comprise mating corresponding components on the drilling end of drill string 144 and engagement end 410 of drill bit 400. It should be understood that, once the new drill bit 400 has been installed on drill string 144, via the attachment mechanism, drill 140 may be used in a drilling operation.

In an embodiment in which magazine 200 comprises a magazine lid 230, process 800 may also comprise opening magazine lid 230. In particular, controller may, in response to determining to change a drill bit 400 (i.e., "Yes" in subprocess 810), open magazine lid 230 of magazine 200. It should be understood that magazine lid 230 may only need to be opened once during an iteration of subprocesses 815-850, in or before subprocess 830. In such an embodiment, process 800 may also comprise closing magazine lid 230. It should be understood that magazine lid 230 may only need to be closed once during an iteration of subprocesses 815-850, in or after subprocess 850.

Figure 9:
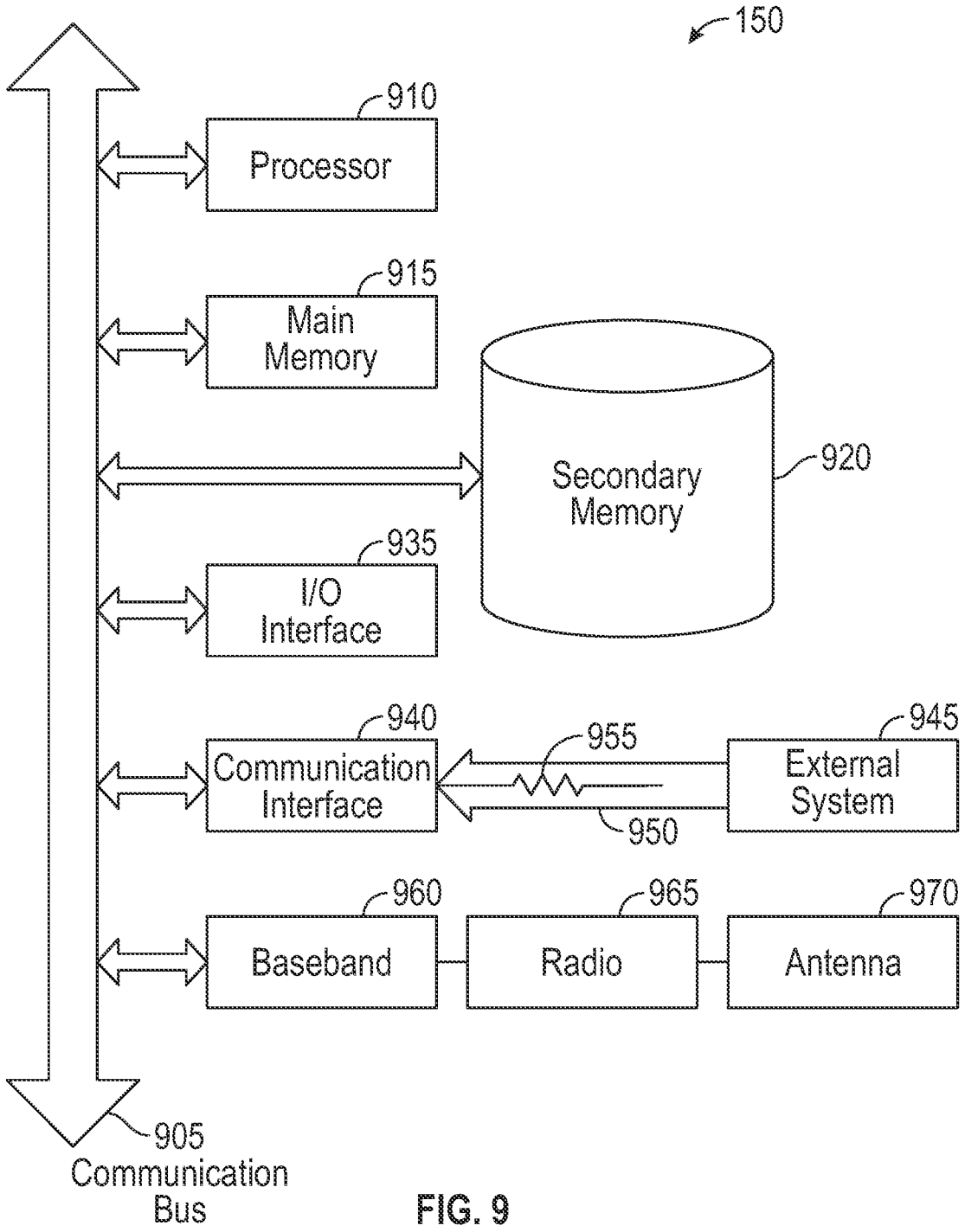
FIG. 9 illustrates a controller for the automated changing of drill bits, according to an embodiment.

FIG. 9 illustrates a controller 150 for the automated changing of drill bits 400, according to an embodiment. For example, controller 150 may implement process 800 and/or other control processes of drilling rig 100 described herein. While controller 150 is illustrated with a particular architecture, it should be understood that other architectures may be used, and that one or more described components may be omitted from controller 150 and/or other components may be added to controller 150.

Controller 150 may comprise one or more processors 910. Processor(s) 910 may comprise a central processing unit (CPU). Additional processors may be provided, such as a graphics processing unit (GPU), an auxiliary processor to manage input/output, an auxiliary processor to perform floating-point mathematical operations, a special-purpose microprocessor having an architecture suitable for fast execution of signal-processing algorithms (e.g., digital-signal processor), a subordinate processor (e.g., back-end processor), an additional microprocessor or controller for dual or multiple processor systems, and/or a coprocessor. Such auxiliary processors may be discrete processors or may be integrated with a main processor 910. Examples of processor 910 which may be used with controller 150 include, without limitation, any of the processors (e.g., Pentium™, Core i7™, Core i9™, Xeon™, etc.) available from Intel Corporation of Santa Clara, California, any of the processors available from Advanced Micro Devices, Incorporated (AMD) of Santa Clara, California, any of the processors (e.g., A series, M series, etc.) available from Apple Inc. of Cupertino, any of the processors (e.g., Exynos™) available from Samsung Electronics Co., Ltd., of Seoul, South Korea, any of the processors available from NXP Semiconductors N. V. of Eindhoven, Netherlands, and/or the like.

Processor(s) 910 may be connected to a communication bus 905. Communication bus 905 may include a data channel for facilitating information transfer between storage and other peripheral components of controller 150. Furthermore, communication bus 905 may provide a set of signals used for communication with processor(s) 910, including a data bus, address bus, and/or control bus (not shown). Communication bus 905 may comprise any standard or non-standard bus architecture such as, for example, bus architectures compliant with industry standard architecture (ISA), extended industry standard architecture (EISA), Micro Channel Architecture (MCA), peripheral component interconnect (PCI) local bus, standards promulgated by the Institute of Electrical and Electronics Engineers (IEEE) including IEEE 488 general-purpose interface bus (GPIB), IEEE 696/S-100, and/or the like.

Controller 150 may comprise main memory 915. Main memory 915 provides storage of instructions and data for programs executing on processor(s) 910, such as any of the software disclosed herein. It should be understood that programs stored in the memory and executed by processor (s) 910 may be written and/or compiled according to any suitable language, including without limitation C/C++, Java, JavaScript, Perl, Python, Visual Basic, .NET, and the like. Main memory 915 is typically semiconductor-based memory such as dynamic random access memory (DRAM) and/or static random access memory (SRAM). Other semiconductor-based memory types include, for example, synchronous dynamic random access memory (SDRAM), Rambus dynamic random access memory (RDRAM), ferroelectric random access memory (FRAM), and the like, including read only memory (ROM).

Controller 150 may comprise secondary memory 920. Secondary memory 920 is a non-transitory computer-readable medium having computer-executable code and/or other data, including any of the software disclosed herein (e.g., software implementing process 800), stored thereon. In this description, the term "computer-readable medium" is used to refer to any non-transitory computer-readable storage media used to provide computer-executable code and/or other data to or within controller 150. The computer software stored on secondary memory 920 is read into main memory 915 for execution by processor(s) 910. Secondary memory 920 may include, for example, semiconductor-based memory, such as programmable read-only memory (PROM), erasable programmable read-only memory (EPROM), electrically erasable read-only memory (EEPROM), and flash memory (block-oriented memory similar to EEPROM).

Controller 150 may comprise an input/output (I/O) interface 935. I/O interface 935 provides an interface between one or more components of controller 150 and one or more input and/or output devices. Example input devices include, without limitation, sensors, keyboards, touch screens or other touch-sensitive devices, cameras, biometric sensing devices, computer mice, trackballs, pen-based pointing devices, and/or the like. Examples of output devices include, without limitation, other processing systems, cathode ray tubes (CRTs), plasma displays, light-emitting diode (LED) displays, liquid crystal displays (LCDs), printers, vacuum fluorescent displays (VFDs), surface-conduction electron-emitter displays (SEDs), field emission displays (FEDs), and/or the like. In some cases, an input and output device may be combined, such as in the case of a touch panel display (e.g., in a console within cabin 114).

Controller 150 may comprise a communication interface 940. Communication interface 940 allows software to be transferred between controller 150 and external devices, networks, or other information sources and/or destinations. For example, computer-executable code and/or data may be transferred to controller 150 from a network server via communication interface 940. Examples of communication interface 940 include a built-in network adapter, network interface card (NIC), Personal Computer Memory Card International Association (PCMCIA) network card, card bus network adapter, wireless network adapter, Universal Serial Bus (USB) network adapter, modem, a wireless data card, a communications port, an infrared interface, an IEEE 1394 fire-wire, and any other device capable of interfacing controller 150 with a network or another processing device. Communication interface 940 preferably implements industry-promulgated protocol standards, such as Ethernet IEEE 802 standards, Fiber Channel, digital subscriber line (DSL), asynchronous digital subscriber line (ADSL), frame relay, asynchronous transfer mode (ATM), integrated digital services network (ISDN), personal communications services (PCS), transmission control protocol/Internet protocol (TCP/IP), serial line Internet protocol/point to point protocol (SLIP/PPP), and so on, but may also implement customized or non-standard interface protocols as well.

Software transferred via communication interface 940 is generally in the form of electrical communication signals 955. These signals 955 may be provided to communication interface 940 via a communication channel 950 between communication interface 940 and an external system 945 (e.g., a remote terminal or platform). In an embodiment, communication channel 950 may be a wired or wireless network, or any variety of other communication links. Communication channel 950 carries signals 955 and can be implemented using a variety of wired or wireless communication means including wire or cable, fiber optics, conventional phone line, cellular phone link, wireless data communication link, radio frequency ("RF") link, or infrared link, just to name a few.

Controller 150 may comprise wireless communication components that facilitate wireless communication over a data network. The wireless communication components comprise an antenna system 970, a radio system 965, and a baseband system 960. In controller 150, RF signals are transmitted and received over the air by antenna system 970 under the management of radio system 965. These wireless communication components may represent a wireless communication interface by which controller 150 may wirelessly communicate with an external system 945, such as a remote platform (e.g., hosting an autonomous system), remote terminal (e.g., by which a remote human operator may control drilling rig 100), and/or the like.

In an embodiment, antenna system 970 may comprise one or more antennae and one or more multiplexors (not shown) that perform a switching function to provide antenna system 970 with transmit and receive signal paths. In the receive path, received RF signals can be coupled from a multiplexor to a low noise amplifier (not shown) that amplifies the received RF signal and sends the amplified signal to radio system 965.

In an alternative embodiment, radio system 965 may comprise one or more radios that are configured to communicate over various frequencies. In an embodiment, radio system 965 may combine a demodulator (not shown) and modulator (not shown) in one integrated circuit (IC). The demodulator and modulator can also be separate components. In the incoming path, the demodulator strips away the RF carrier signal leaving a baseband receive signal, which is sent from radio system 965 to baseband system 960.

In an embodiment that is implemented using software, the software may be stored on a computer-readable medium and initially loaded into controller 150 by way of I/O interface 935, communication interface 940, or baseband 960. In such an embodiment, the software is loaded into controller 150 in the form of electrical communication signals 955. The software, when executed by processor(s) 910, may cause processor(s) 910 to perform one or more of the processes (e.g., process 800) and other functions described elsewhere herein.

INDUSTRIAL APPLICABILITY

Disclosed embodiments provide a magazine 200 on platform 112 of a drilling rig 100. Magazine 200 houses a plurality of drill-bit pockets 212 arranged in at least one column. Each column comprises two or more vertically arranged drill-bit pockets 212. Each drill-bit pocket 212 is configured to receive at least a portion of drilling end 420 of a drill bit 400, such that an engagement end 410 of drill bit 400 is accessible at the open end of the drill-bit pocket 212. In addition, within each column, each drill-bit pocket 212 is configured (e.g., angled) to hold drill bit 400 at an angle B that is different, with respect to reference axis R, than the angle B of any others of the drill-bit pockets 212 in the same column. Vertically lower drill-bit pockets 212 have larger angles B than vertically higher drill-bit pockets 212.

As a result of the configuration of magazine 200, drill 140 may interact with any one of the drill-bit pockets 212 in a column of magazine 200 by matching the angle A of drill 140 to the angle B of the drill-bit pocket 212. During normal operations, controller 150 may control mast 130 to tilt drill 140 between a range of angles with respect to reference axis R. During process 800, controller 150 uses this function to tilt drill 140 to the angle B of any selected one of the plurality of drill-bit pockets 212, so as to align drill axis D of drill 140 with an engagement axis E of the selected drill-bit pocket 212 within a column. It should be understood that the angle B for each of the vertically arranged drill-bit pockets 212 in each column will be within the range of angles within which drill 140 is able to tilt. Thus, the existing ability of drill 140 to tilt is co-opted by process 800 to automatically change drill bits 400.

In an embodiment, magazine 200 may be slidable along lateral axis L. In particular, controller 150 may be configured to control magazine 200 to slide along lateral axis L, for example, by using a hydraulic piston or other mechanism to push and pull magazine 200 on one or more rails 300 that are each oriented along lateral axis L. Thus, magazine 200 may comprise rows of two or more drill-bit pockets 212, and controller 150 may control magazine 200 to slide along rail(s) 300, so as to align drill axis D of drill 140 with an engagement axis E of a selected drill-bit pocket 212 within a row.

As discussed above, controller 150 may control mast 130 to set angle A of drill axis D of drill 140, and/or control the position of magazine 200 along lateral axis L, to thereby align drill axis D with any drill-bit pocket 212 of magazine 200. Once aligned, drill string 144 of drill 140 may be operated to release a drill bit 400 from drill string 144 into an empty drill-bit pocket 212 or engage a drill bit 400 being held in an occupied drill-bit pocket 212. Accordingly, process 800 may be executed by controller 150, to automatically change the drill bits 400 installed on drill string 144, in response to one or more triggers (e.g., a user operation, control command from an autonomous system, change in status of the currently installed drill bit 400, detected local event, etc.).

Advantageously, disclosed embodiments can provide automated changing of drill bits 400 without the need for rotating carousels of drill bits 400 or other complicated mechanical movements and structures. Magazine 200 can be implemented as a simple structure that requires only simple movements (e.g., lateral sliding, opening and closing of magazine lid 230, etc.) or no movement at all (e.g., if magazine 200 consists of a single column of drill-bit pockets 212 and has no magazine lid 230). This improved design reduces manufacturing costs and complexity, and reduces the likelihood of mechanical failures which, in turn, reduces downtime of drilling rig 100

To utilize process 800, an operator simply needs to load at least a subset of drill-bit pockets 212 in magazine 200 with drill bits 400. Alternatively, the operator may replace the entire magazine 200, for example, by detaching a used magazine 200 (e.g., containing used drill bits 400) from platform 112 and attaching a new magazine 200 (e.g., containing new drill bits 400) to platform 112. In either case, this loading may only need to be done once at the start of a drilling operation. Once magazine 200 has been loaded, process 800 may operate throughout the drilling operation to change drill bits 400 as needed (e.g., whenever subprocess 810 determines that drill bit 400 needs to be changed), without the need for any human intervention, to thereby increase the efficiency of drilling operations.

It will be understood that the benefits and advantages described above may relate to one embodiment or may relate to several embodiments. Aspects described in connection with one embodiment are intended to be able to be used with the other embodiments. Any explanation in connection with one embodiment applies to similar features of the other embodiments, and elements of multiple embodiments can be combined to form other embodiments. The embodiments are not limited to those that solve any or all of the stated problems or those that have any or all of the stated benefits and advantages.

The preceding detailed description is merely exemplary in nature and is not intended to limit the invention or the application and uses of the invention. The described embodiments are not limited to usage in conjunction with a particular type of work machine. Hence, although the present embodiments are, for convenience of explanation, depicted and described as being implemented in a drilling rig, it will be appreciated that it can be implemented in various other types of machines with a rotatable and extendable tool that has an exchangeable attachment at one end, and in various other systems and environments. Furthermore, there is no intention to be bound by any theory presented in any preceding section. It is also understood that the illustrations may include exaggerated dimensions and graphical representation to better illustrate the referenced items shown, and are not considered limiting unless expressly stated as such.

What is claimed is:

1. A magazine to hold drill bits for a drilling rig, the magazine comprising:

a housing that includes a plurality of drill-bit pockets, wherein each of the plurality of drill-bit pockets is configured to receive at least a portion of a drilling end of a drill bit, such that an engagement end of the drill bit is accessible at an open end of that drill-bit pocket, wherein the plurality of drill-bit pockets comprises one or more columns of two or more vertically arranged drill-bit pockets such that at least a first one of the plurality of drill-bit pockets is positioned vertically below a second one of the plurality of drill-bit pockets, and wherein when the magazine of the drilling rig is in a position, the first drill-bit pocket holds a first drill bit such that a longitudinal axis of the first drill bit is held at a first angle with respect to a reference axis, and wherein the second drill-bit pocket holds a second drill bit such that a longitudinal axis of the second drill bit is held at a second angle with respect to the reference axis, wherein the second angle is smaller than the first angle.

2. The magazine of claim 1, wherein the first drill-bit pocket is angled at the first angle with respect to the reference axis, and wherein the second drill-bit pocket is angled at the second angle with respect to the reference axis.

3. The magazine of claim 1, further comprising a magazine lid that is configured to open, to provide access to an open end of each of the plurality of drill-bit pockets, and close, to prevent access to the open end of each of the plurality of drill-bit pockets.

4. The magazine of claim 1, further comprising one or more engagement members configured to fix the housing to a platform of the drilling rig.

5. The magazine of claim 1, wherein the plurality of drill-bit pockets comprises at least one column of three or more vertically arranged drill-bit pockets, including the first and second drill-bit pockets.

6. The magazine of claim 1, wherein each of the plurality of drill-bit pockets is configured to hold a same type of drill bit.

7. The magazine of claim 1, wherein each of one or more of the plurality of drill-bit pockets is configured to hold a different type of drill bit than at least one other one of the plurality of drill-bit pockets.

8. The magazine of claim 1, wherein the plurality of drill-bit pockets comprises two or more rows of laterally arranged drill-bit pockets, wherein, in a first one of the two or more rows, all of the drill-bit pockets hold drill bits such that longitudinal axes of the drill bits are held at the first angle, and wherein, in a second one of the two or more rows that is positioned vertically above the first row, all of the drill-bit pockets hold drill bits such that longitudinal axes of the drill bits are held at the second angle.

9. An assembly comprising:

one or more rails that are each oriented along a lateral axis that is orthogonal to the reference axis; and the magazine of claim 4, wherein the magazine further comprises one or more engagement members that are configured to slidably engage the magazine with the one or more rails, such that the magazine is controllable to slide along the one or more rails in both directions along the lateral axis.

10. The assembly of claim 9, wherein the one or more engagement members are at least two engagement members spaced apart along the reference axis, and wherein the one or more rails are at least two rails spaced apart along the reference axis, and wherein each of the at least two engagement members is configured to slidably engage with a respective one of the at least two rails.

11. A drilling rig comprising:

a machine body comprising a platform that defines the reference axis;

a mast attached to the machine body and configured to tilt a drill between a range of angles with respect to the reference axis, wherein the range of angles includes the first angle and the second angle;

one or more ground-engaging members configured to move the machine body with respect to a ground; and the magazine of claim 1, wherein the magazine is attached to the platform.

12. The drilling rig of claim 11, further comprising a controller that is configured to:

determine to change a used drill bit; and in response to determining to change the used drill bit, select an empty one of the plurality of drill-bit pockets in the magazine, control the mast to tilt the drill to an angle, with respect to the reference axis, that matches an angle of the selected empty drill-bit pocket, operate a drill string of the drill to release the used drill bit into the selected empty drill-bit pocket, select an occupied one of the plurality of drill-bit pockets in the magazine, control the mast to tilt the drill to an angle, with respect to the reference axis, that matches an angle of the selected occupied drill-bit pocket, and operate the drill string of the drill to engage a new drill bit held by the selected occupied drill-bit pocket.

13. The drilling rig of claim 12, wherein the controller is further configured to, in response to determining to change the used drill bit, open a lid of the magazine.

14. The drilling rig of claim 12, wherein the plurality of drill-bit pockets comprises two or more rows of laterally arranged drill-bit pockets, wherein, in a first one of the two or more rows, all of the drill-bit pockets hold drill bits such that longitudinal axes of the drill bits are held at the first angle, wherein, in a second one of the two or more rows that is positioned vertically above the first row, all of the drill-bit pockets hold drill bits such that longitudinal axes of the drill bits are held at the second angle, wherein the drilling rig further comprises one or more rails that are each oriented along a lateral axis that is orthogonal to the reference axis, and wherein the magazine further comprises one or more engagement members that are configured to slidably engage with the one or more rails, such that the magazine is controllable to slide along the one or more rails in both directions along the lateral axis.

15. The drilling rig of claim 14, wherein the controller is further configured to, in response to determining to change the used drill bit, slide the magazine along the one or more rails to align one or both of the selected empty drill-bit pocket or the selected occupied drill-bit pocket with the drill string.

16. The drilling rig of claim 12, wherein determining to change the used drill bit comprises receiving a user operation.

17. The drilling rig of claim 12, wherein determining to change the used drill bit comprises automatically determining to change the used drill bit based on a status of the used drill bit.

18. A drilling rig comprising:

a machine body comprising a platform that defines a reference axis;

a magazine attached to the platform, wherein the magazine comprises a housing that includes a plurality of drill-bit pockets, wherein each of the plurality of drill-bit pockets is configured to receive at least a portion of a drilling end of a drill bit, such that an engagement end of the drill bit is accessible at an open end of that drill-bit pocket, wherein the plurality of drill-bit pockets comprises one or more columns of two or more vertically arranged drill-bit pockets, and wherein each of the two or more vertically arranged drill-bit pockets in each of the one or more columns is angled at an angle that is different with respect to the reference axis than the angle of any others of the two or more vertically arranged drill-bit pockets in that column;

a mast attached to the machine body and configured to tilt a drill between a range of angles with respect to the reference axis, wherein the range of angles includes the angle of each of the two or more vertically arranged drill-bit pockets in each of the one or more columns;

one or more ground-engaging members configured to move the machine body with respect to a ground; and a controller configured to change a used drill bit of the drill by controlling the mast to tilt the drill to the angle of any selected one of the plurality of drill-bit pockets, so as to align a drill axis of the drill with an engagement axis of the selected drill-bit pocket.

19. The drilling rig of claim 18, wherein the plurality of drill-bit pockets comprises two or more rows of laterally arranged drill-bit pockets, wherein, in a first one of the two or more rows, all of the drill-bit pockets hold drill bits such that longitudinal axes of the drill bits are held at a first angle, wherein, in a second one of the two or more rows that is positioned vertically above the first row, all of the drill-bit pockets hold drill bits such that longitudinal axes of the drill bits are held at a second angle that is smaller than the first angle, wherein the drilling rig further comprises one or more rails that are each arranged along a lateral axis that is orthogonal to the reference axis, wherein the magazine further comprises one or more engagement members that are configured to slidably engage the one or more rails, such that the magazine is controllable to slide along the one or more rails in both directions along the lateral axis, and wherein the controller is further configured to change the used drill bit by controlling the magazine to slide along the one or more rails, so as to align a drill axis of the drill with an engagement axis of the selected drill-bit pocket.

20. A controller of a drilling rig, the drilling rig comprising a machine body comprising a platform that defines a reference axis, a magazine, wherein the magazine comprises a housing that includes a plurality of drill-bit pockets, wherein each of the plurality of drill-bit pockets is configured to receive at least a portion of a drilling end of a drill bit, such that an engagement end of the drill bit is accessible at an open end of that drill-bit pocket, wherein the plurality of drill-bit pockets comprises one or more columns of two or more vertically arranged drill-bit pockets, and wherein each of the two or more vertically arranged drill-bit pockets in each of the one or more columns is angled at an angle that is different with respect to the reference axis than the angle of any others of the two or more vertically arranged drill-bit pockets in that column, and a mast attached to the machine body and configured to tilt a drill between a range of angles with respect to the reference axis, wherein the range of angles includes the angle of each of the two or more vertically arranged drill-bit pockets in each of the one or more columns, wherein the controller is configured to:

determine to change a used drill bit; and in response to determining to change the used drill bit, select an empty one of the plurality of drill-bit pockets in the magazine, control the mast to tilt the drill to an angle, with respect to the reference axis, that matches an angle of the selected empty drill-bit pocket, operate a drill string of the drill to release the used drill bit into the selected empty drill-bit pocket, select an occupied one of the plurality of drill-bit pockets in the magazine, control the mast to tilt the drill to an angle, with respect to the reference axis, that matches an angle of the selected occupied drill-bit pocket, and operate the drill string of the drill to engage a new drill bit held by the selected occupied drill-bit pocket.

* * * * *